US005976313A

United States Patent [19]

Maguire, III

[11] Patent Number: 5,976,313

[45] Date of Patent: Nov. 2, 1999

[54] ADJUSTABLE SPRAY MOISTENER FOR ENVELOPES

[75] Inventor: John N. Maguire, III, 149 Cabana Rd., Myrtle Beach, S.C. 29572

[73] Assignee: John N. Maguire, III

[21] Appl. No.: 09/050,262

[22] Filed: Mar. 30, 1998

[51] Int. Cl.[6] ..... B43M 5/00; B43M 5/04

[52] U.S. Cl. ..... 156/441.5; 156/442; 118/680

[58] Field of Search ..... 156/441.5, 442.1, 156/442.2, 442.3, 442.4, 442; 118/680

[56] References Cited

U.S. PATENT DOCUMENTS

| | | | |
|---|---|---|---|
| 626,899 | 6/1899 | Gaskill | 156/441.5 |
| 714,624 | 11/1902 | Turner | 156/442.4 |
| 1,027,204 | 5/1912 | Hammond | 156/441.5 X |
| 1,035,294 | 8/1912 | Young | 156/441.5 |
| 1,846,969 | 2/1932 | Kalenoff | 156/442.4 |
| 3,911,862 | 10/1975 | Lupkas | 118/680 |
| 4,924,805 | 5/1990 | O'Dea | 118/680 |
| 5,007,371 | 4/1991 | O'Dea et al. | 118/680 |
| 5,020,473 | 6/1991 | Bergman | 118/442.2 X |
| 5,242,499 | 9/1993 | Bergman | 156/442.2 X |
| 5,569,327 | 10/1996 | Paradis et al. | 156/441.5 X |
| 5,674,348 | 10/1997 | DeFiguerido | 156/441.5 |
| 5,840,123 | 11/1998 | Holbrook | 156/441.5 X |

*Primary Examiner*—James Sells
*Assistant Examiner*—Sue A. Purvis

[57] ABSTRACT

This invention relates to the creation of a swifter, cleaner, way of moistening envelope flaps to seal them. It represents an improvement over other designs of systems using nozzles in that it adjust for a variety of envelope flap shapes and lengths and depths. It is also an improvement over sponge or wick systems, since no glue build up is created. With a push of a button, a spray of water or sealing fluid, is directed to the flap, after symmetric geared adjustable arms, each arm geared at a pivot between them, are positioned (including a valve on each arm to adjust for a smaller envelope flap). After the envelope is positioned and the button is pushed, a spray of fluid falls upon the flap, directed downward by a number of nozzles on each arm, all connected to the pump and fluid reservoir by flexible tubes and conduits. The spring button returns to position, while drawing fluid up into the small piston pump to be used for another envelope. An electric version would utilize an electric solenoid to activate a piston pump, or use an electric rotary pump.

13 Claims, 2 Drawing Sheets

ADJUSTABLE SPRAY MOISTENER FOR ENVELOPES

BACKGROUND OF THE INVENTION

1. Field of the Invention

In an effort to hasten and streamline, and make easier, the sealing of envelopes with water activated glue flaps, or the application of liquid glue to a non-glued envelope flap; several solutions and styles of mechanisms have been developed. The use of sponges, moistened rolllerballs, wicks, brushes, pads, and spray nozzles, have been proposed to accomplish moistening of envelope flaps.

This present invention is the only envelope mister-sprayer in this field that utilizes an adjustable synchronous mechanism that allows movement of the two arms containing spray nozzles, to move to align on different shaped, different angled symmetric envelope flaps.

2. Description of the Prior Art

This style of mechanism (spray system) is an improvement over existing mechanisms that moisten or seal envelopes, or other material, that use sponges, brushes, roller balls, or other existing systems.

A spray system does not receive a glue build-up from the material to be moistened or sealed. This invention is also much faster, sealing, moistening or gluing an envelope then the existing before mentioned devices.

This invention also uses less energy of the operator, leading to greater productivity.

It adjusts for different lengths and shapes of envelope flaps, which previous sealers do not do.

This invention is cleaner and more sanitary than other style envelope sealers, since bacteria can grow on: the glue build up, in and on the material of: Sponges, brushes, wicks, roller-balls, or any other material contact system. This invention also provides greater sealing, since there is no glue lost, due to a contact system. With a spray system 100% of the glue stays on the envelope, or material to be sprayed. If a liquid adhesive is used, then no loss to build up on a sponge, brush, wick—and no need to replace these items when they wear out. Sponge, wick, brush, or similar systems will need replacing due to wear and glue build-up. This invention does not need to replace parts due to glue build-up or physical contact wear on surface to be glued, or applied to.

This invention adjusts for different shaped envelopes, where as other existing mechanisms do not. And previous relevant inventions only provide for one shape sealing area. Wick, brush, or roller-ball or similar systems, the operator must move the envelope in order to seal. An operator need only place an envelope once, with no movement needed, under the adjustable arms, when utilizing this invention.

This invention loses very little, if any, water or fluid to evaporation to the atmosphere. Where as wick, sponge, brush, or similar systems loose a great deal of water or fluid to the atmosphere; which means more inconvenient replenishing of the fluid reservoir.

SUMMARY OF THE INVENTION

Figure 1:
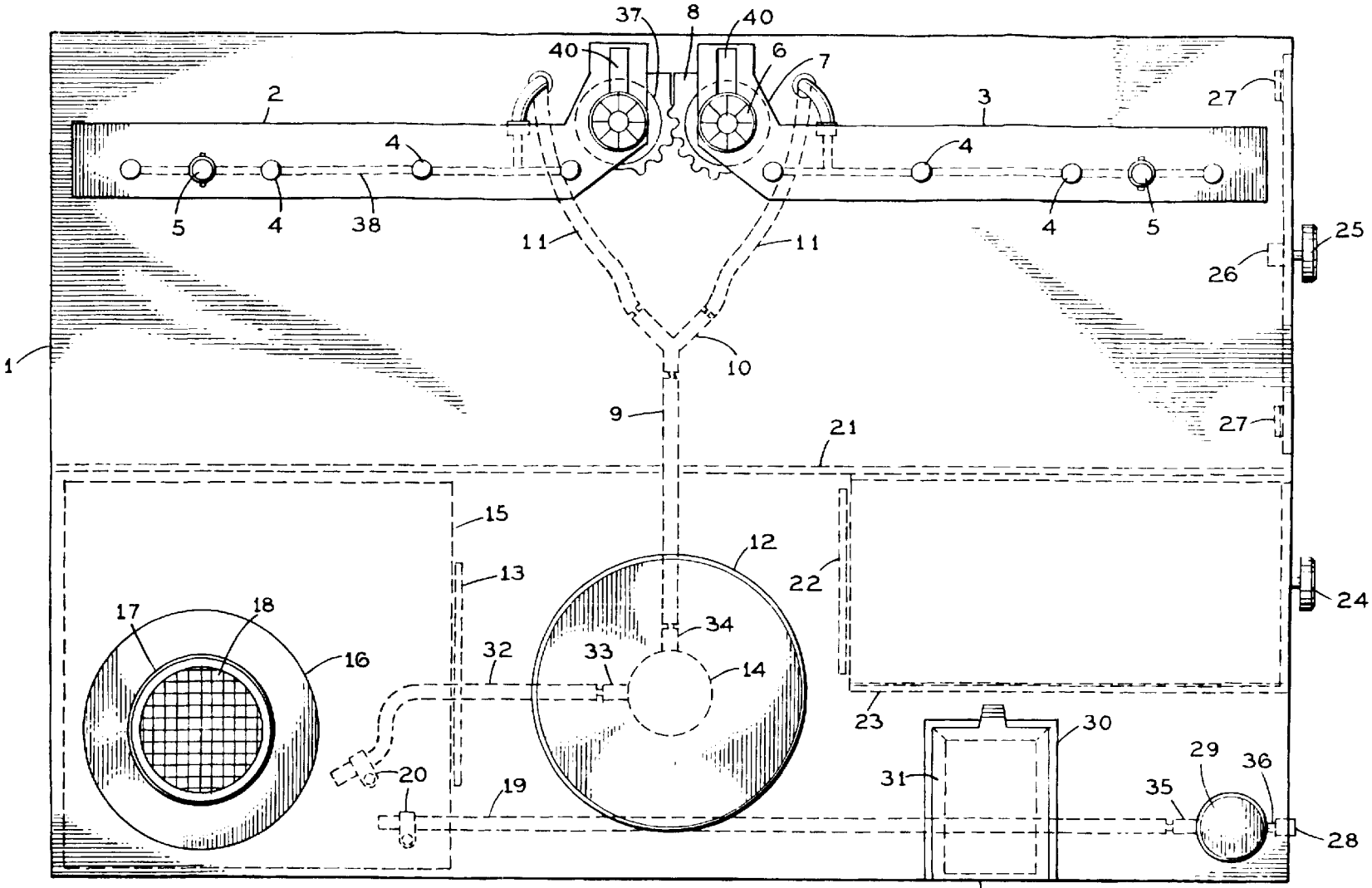
FIG. 1 is a top view showing of the envelope sprayer, showing all parts, within and without the housing.
Figure 2:
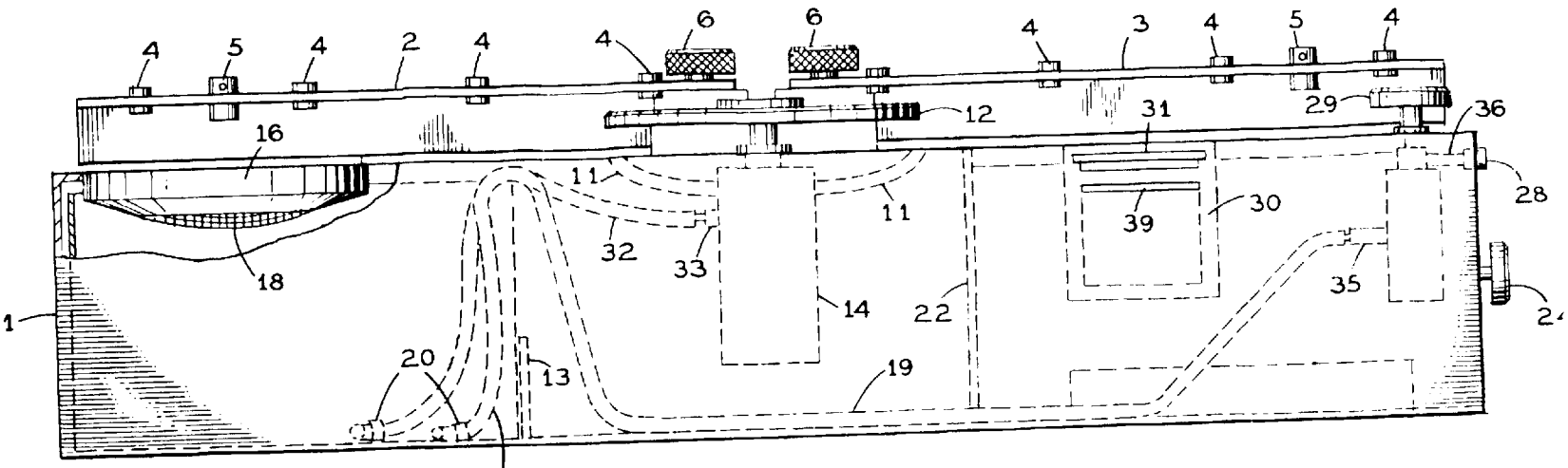
FIG. 2 is a front view of the invention, allowing more visual data and granting an accurate depth of field.
Figure 3:
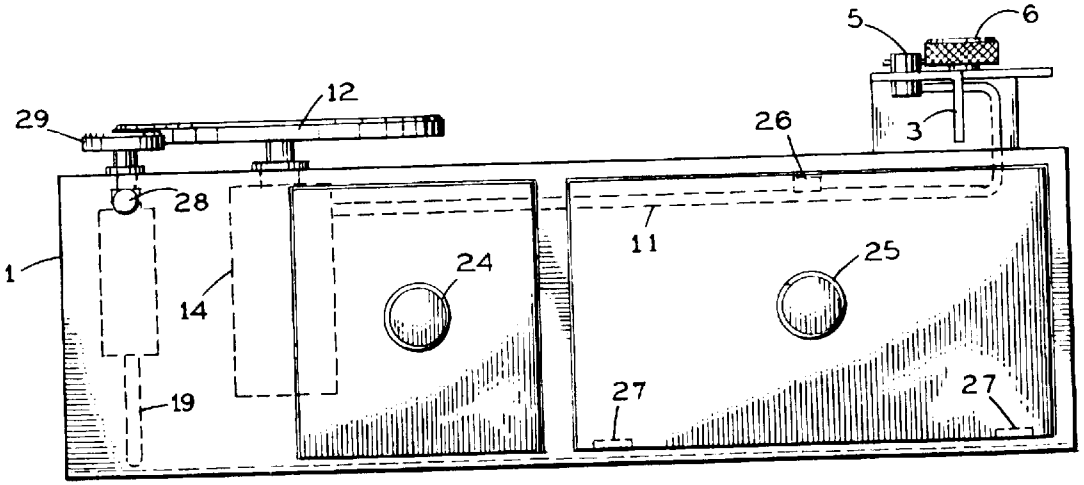
FIG. 3 is the right side, granting more details of the invention.

This invention represents an improvement over previous designs, due to it's adjustable design for different shaped envelope flaps, the pivoted arms adjust for different symmetric angles and for different depths of glue area of envelope flaps. The adjustable design represents an improvement over set non-adjustable envelope sealers. It can also represent an improvement over single spray systems that move a nozzle to spray a passing envelope, since a plurality of nozzles, in arms to adjust for different shapes, could spray the entire flap faster than a single moveable nozzle which must spray the length of the flap as it moves by horizontally and while also moving vertically to adjust for envelope shape. Thus with arms of nozzles to adjust for the shape, mechanisms to move a single nozzle are not needed, leading to more dependability and faster application for sealing.

DESCRIPTION OF THE PREFERRED EMBODIMENT

This invention consists of housing (1) rectangular or other shape, comprising of a container for fluid (15) or the use of the housing itself as a reservoir, pump (manual or electric, or pressurized system) (14). Two symmetric geared arms (2&3) to hold nozzles (4) to adjust to and spray envelopes. A solid conduit or flexible tubes (11) from pump to nozzles. Moveable tubes or situated tubes or conduit, so as to enable arms to move, while still ensuring a leak proof supply of fluid. Arms centered by a gear, or similar attach of friction mechanism, (8) on each arm to pivot and move both arms in unison, to enable symmetry, for various shaped and angled envelope flaps. Arms placed right end to left end, the left arm with gear on right side—the right arm with gear on left side, arms placed left arm right end to right arm left end, gears meshed together. Gears side by side connected to housing by circular bolt or other means. One or both arms to have knob (37) to release tension to move and adjust; and cause tension to hold it in place. The use of a tension ratchet system, to click arms in place is also an option.. Thus, such holding mechanisms cause both arms to stay in position for one type of shaped envelope flap, the angles of the flap match the arms' angles at the gear pivot. For another shape turn knobs to release, and then adjust to the shape of the glued area on a new envelope shape. Gears permit movement from straight 180 degrees, to approximately 90 degrees from each other. Movement of the arms back and forward, can adjust for different depths of glue areas, with the hollowed cut out slot (40), to vary depth from the arm holder pivot posts, where the envelope flap edge is stooped.

The arms composed of an optional 90 degree angle horizontal top/to hold nozzles. Without the 90 degree backdrop, more depth is gained, otherwise the vertical side toward the rear of the housing acts as a stop and placement guide for the glue flap of an envelope. Another vertical side towards the front of the housing is optional, to help guide the sprayed fluid to the glue area only, avoiding the rest of the envelope. The use of rectangular spray pattern nozzles to produce a rectangular spray pattern, would eliminate the need for a spray guide. The use of more common round spray pattern nozzles would prefer the vertical side toward the front of the housing to guide the spray. The spray guide would not be as large a width as the rear stop guide—which also supports the arms, as it rests on the housing.

A solid arm with built in or drilled nozzles, is an option, thus no need of tubes located on the arm to connect the nozzles, since a conduit is in the arm itself, through which the nozzles can tap into.

Arms would hold a number of nozzles, depending on spray pattern of the nozzles. Values toward ends or each arm would shut off spray for some nozzles, to enable smaller envelopes to be sprayed, without usage the entire arms length of nozzles. With shut off valves, different sizes can be sprayed without waste of liquid.

The nozzle construction should be so, that the internal diameter is of proper size to allow back pressure build up, which allows equal distribution of fluid to all the nozzles, creating an equal amount of spray from each nozzle.

A slot (40) on each arm pivot would permit more of an angle, and greater access to a glue area of some envelopes.

Push Button (12) located near front of housing—connected to the pump's piston plunger; would be depressed to move water to nozzles to envelopes. A large hinged flap of rigid material could be placed on the push button pump and hinged near the middle of the housing, for a wider area for easier use. (less pressure needed to press, more space to depress). Electric model: the push button would be depressed to enable circuit closure of electrical system—to activated solenoid (electric magnet) or electric rotary motor, which would then activate pump. Water pressure and air pressure models: The push button would release a valve for a brief sufficient time to enable a burst of fluid spray on an envelope. Or a solenoid with a timer switch to adjust the time of value release—enabling a short duration burst of spray. Or a mechanical devise to permit the same timing adjustments.

Manual pump would be of single dependable design—similar to many spray pumps on liquid products. Electric solenoid version, would connect to a lever attached to a pump's plunger, or direct to a pump's activation apparatus. A flexible tube or conduit would lead to the pump form a container of fluid, or the fluid could be stored in the housing itself. But a container would be safer and more leak proof, especially if dropped.

A hole in the bottom of the housing, under the pump location would allow leakage if a small leak developed in pump.

A preferably recessed screw cap spout with a screen (16,17,18) to catch any material big enough to clog the nozzles, or clog the pump. Fluid intake spout to be located in the housing near, or a part of, the fluid container (15). Fluid container is preferably composed of a non-corrosive material (rust particles would damage nozzles). Cap and spout preferably located to the left of the push button. So the stamp sprayer (28,29) can be placed on the right of the housing—since envelopes could be more conveniently sprayed on the right corner of the envelope for stamp placement.

Other stamp spray designs: 2. Recessed rectangular depression with a nozzle in it to spray vertically at the same time as the envelope sealer. This design stamp sprayer would be located where the stamp would be placed on the envelope as it is placed on the top of the housing. off the side sprayer built into housing (28,29). place where stamps would be needed: the stamp space on regular size envelopes and regular business envelopes would be sprayed the same time as the envelope flap—a stamp placed on the sprayed area when the envelope is removed after the flap is sealed. Both nozzles, one for each space of different size envelopes, would have a stop valve to choose which size envelope to be sprayed. As the envelop is moved back to seal—an open depression in the surface of the housing would prevent the liquid from being removed from the stamp area and staying on the housing surface. Optional design 3: A rectangular space in top of envelope sprayer housing would have a Velcro material pad and nozzle would have a stamp size base with Velcro on bottom to attach to the pad. A flexible tube would go from pump to nozzle on pad. This would adjust for a wider variety of envelope sizes.

A stamp dispenser, located preferably, at the right of the housing: Three designs: 1. A manual feed with room for 1 roll and a slot for feed. Hinge near bottom of housing, and a catch to hold it at top of housing (30,31,39). 2. A manual feed with two parallel guides and open space in rectangular form for push feed though a guide conduit, so stamps can be torn off with one hand. 3. A manual "push button" and move feed. Spring held button, when depressed would contact stamps and then operator moves it down the guide slot, which is as long as a standard American stamp, a return spring could also be used.

A drawer (24) preferably to the right of the stamp dispenser could hold stamp books and other items. The drawer would be held in place by guide walls (21,22,23), which are located in the internal space of the housing, and also act as structural supports. At the top of the back wall of the drawer, a notch protruded from the top of the back drawer wall to keep from falling out.

A small cabinet with hinges (27) at the bottom of the cabinet door and a latch (26) at the top of it. The door and internal space of a size to permit storage of envelopes. Preferably located to the right side of the small stamp storage drawer.

Another design of this entire device would incorporate the spray parts (pump, reservoir) in the envelope cabinet section, and eliminating the previously used space, thus halving the space of the housing—which would enable easier storage of the device, since it would be half the size of the drawn design which includes the envelope storage cabinet.

I claim:

1. An envelope moistening system compromising: a pair of arms symmetrically arranged, each arm including a plurality of nozzles along the length of the arm; a pivot point associated with an end of each arm, the pivot points being arranged in the vicinity of each other; means for simultaneously pivoting both arms simultaneously to maintain the symmetry of the arms while simultaneously varying the angle made by the two arms thereby providing adjustment for various flap arrangements of envelopes; means for feeding moistening or gluing liquid to each arm, said means for feeding moistening or gluing liquid including a fluid reservoir and a pump.

2. The system of claim 1 wherein the system is a manual pump system.

3. The system of claim 1, wherein the system is an electromagnetic pump system.

4. The system of claim 1 wherein each arm is a solid arm having the nozzles built therein as well as a means for supplying the nozzles with moistening or gluing liquid built in.

5. The system of claim 1 wherein a type of design of nozzle creates a rectangular spray pattern.

6. The system of claim 1, wherein selected nozzles on each arm may be shut off in order to facilitate spraying of smaller envelopes.

7. The system of claim 1 wherein the means for simultaneously pivoting includes a gear arrangement.

8. The system of claim 1 further including adjustable slots to move arms away from pivot points, to allow for varying depths of different envelopes.

9. The system of claim 1 wherein the fluid reservoir includes a screened intake where fluid is supplied to the reservoir.

10. The system of claim 1 further including an envelope storage cabinet disposed within a housing for the moistening or gluing system.

11. The system of claimed 1 further including a stamp storage drawer disposed within a housing for the moistening or gluing system.

12. The system of claim 1 further including a stamp sprayer built within a housing for the moistening or gluing system.

13. The system of claim 1 further including a stamp roll holder for holding and dispensing a roll of stamps disposed within a housing for the moistening or gluing system.

* * * * *